US008314820B2

(12) United States Patent
Kao et al.

(10) Patent No.: US 8,314,820 B2
(45) Date of Patent: Nov. 20, 2012

(54) BACKLIGHT ADJUSTMENT DEVICE OF A DISPLAY AND METHOD THEREOF

(75) Inventors: Meng-Chao Kao, Taipei (TW); Hsiang-Tan Lin, Keelung (TW); Pei-Lin Hsieh, Taipei County (TW)

(73) Assignee: Chunghwa Picture Tubes, Ltd., Bade, Taoyuan (TW)

( * ) Notice: Subject to any disclaimer, the term of this patent is extended or adjusted under 35 U.S.C. 154(b) by 187 days.

(21) Appl. No.: 13/017,048

(22) Filed: Jan. 30, 2011

(65) Prior Publication Data

US 2012/0154451 A1 Jun. 21, 2012

(30) Foreign Application Priority Data

Dec. 17, 2010 (TW) ..... 99144407 A

(51) Int. Cl.
*G09G 5/10* (2006.01)

(52) U.S. Cl. ..... 345/690; 345/83; 345/89; 345/102

(58) Field of Classification Search ..... 345/83, 345/88, 89, 102, 589, 590, 591, 603–605, 345/690; 382/162, 165, 167
See application file for complete search history.

(56) References Cited

U.S. PATENT DOCUMENTS

| | | | | |
|---|---|---|---|---|
| 5,929,843 | A | 7/1999 | Tanioka | |
| 6,897,876 | B2 | 5/2005 | Murdoch et al. | |
| 7,286,136 | B2 * | 10/2007 | Phan | 345/589 |
| 7,728,846 | B2 | 6/2010 | Higgins et al. | |
| 8,232,944 | B2 * | 7/2012 | Takada et al. | 345/690 |
| 2006/0215191 | A1 * | 9/2006 | Tanase et al. | 358/1.9 |
| 2008/0231577 | A1 * | 9/2008 | Lin et al. | 345/90 |
| 2009/0059078 | A1 * | 3/2009 | Kim et al. | 348/645 |
| 2009/0060360 | A1 * | 3/2009 | Huang et al. | 382/237 |
| 2009/0207182 | A1 * | 8/2009 | Takada et al. | 345/589 |
| 2010/0103187 | A1 * | 4/2010 | Linssen | 345/590 |
| 2011/0102414 | A1 * | 5/2011 | Lin et al. | 345/213 |
| 2011/0109658 | A1 * | 5/2011 | Park | 345/690 |
| 2011/0149166 | A1 * | 6/2011 | Botzas et al. | 348/649 |

OTHER PUBLICATIONS

[Ching-Fu Hsu, Chih-Chang Lai, Jyun-Sian Li], [A Modified Stripe-RGBW TFT-LCD with Image-Processing Engine for Mobile Phone Displays], [2007], [2317-2320], [Taichung and/or Taiwan, R.O.C].
[Alexander Arkhipov, Kyongtae Park, Baek-woon Lee and ChiWoo Kim], [62.2: Adaptive White Extension for Peak Luminance Increase in RGBW AMOLED], [931-934], [S. Korea]., 2009.
[Tun-Chun Yang, Kuo-Yung Hung, Chih-Chun Pei, Chih-Jen Hu, Chih-Ming Chang, Po-Lun Chen, Kun-Yu Lin], [RGBW Transflective TFT LCDs with Adjustable Reflective Color Gamut by Image Processing Algorithm], [2006], [209-214], [IMID/IDMC], [DIGEST], [Hsinchu Taiwan].

* cited by examiner

*Primary Examiner* — Kimnhung Nguyen
(74) *Attorney, Agent, or Firm* — Winston Hsu; Scott Margo

(57) ABSTRACT

A backlight adjustment device includes a color saturation generation unit, a gain generation unit, and an adjustment unit. The color saturation generation unit is used for receiving red, green, and blue sub-pixels of an RGB pixel, and generating a color saturation of the RGB pixel according to the red, green, and blue sub-pixels of the RGB pixel. The gain generation unit is used for generating a gain of the RGB pixel according to the color saturation of the RGB pixel. The adjustment unit is used for adjusting a backlight source according to an average of gains of a plurality of pixels.

12 Claims, 10 Drawing Sheets

BACKLIGHT ADJUSTMENT DEVICE OF A DISPLAY AND METHOD THEREOF

BACKGROUND OF THE INVENTION

1. Field of the Invention

The present invention is related to a backlight adjustment device and method thereof, and particularly to a backlight adjustment device of an RGBW display system and method thereof.

2. Description of the Prior Art

An RGBW display is a display which adds white light on a traditional RGB display. Because the white light does not need a color filter, the RGBW display can provide higher luminance than the traditional RGB display, and reduce power consumption of a backlight source. Compared to the RGB display, the RGBW display has two advantages: 1. the RGBW display can provide higher luminance at the same power consumption; and 2. the power consumption of the RGBW display is lower than that of the RGB display for the same luminance.

However, the RGBW display may decrease luminance of images when the RGBW display displays images with higher color saturation. Please refer to FIG. 1A and FIG. 1B. FIG. 1A is a diagram illustrating ratio of a sub-pixel area to a pixel area of the RGB display and ratio of a sub-pixel area to a pixel area of the RGBW display, and FIG. 1B is a diagram illustrating decrease in the luminance of the images as the RGBW display displays the images with the higher color saturation according to the prior art. As shown in FIG. 1B, taking pure red light as an example, gray levels of the red, green, and blue sub-pixels of the pure red light are (255, 0, 0). After adding a white sub-pixel (min(255, 0, 0)), gray levels of the red, green, blue, and white sub-pixels are (255, 0, 0, 0), so luminance of an RGBW pixel is decreased because area of the red sub-pixel is one fourth area of the RGBW pixel. Therefore, when the RGBW display of the prior art displays the images with lower color saturation, the RGBW display of the prior art has higher luminance at the same power consumption, however, when the RGBW display of the prior art displays the images with the higher color saturation, the images displayed by the RGBW display of the prior art have lower luminance.

SUMMARY OF THE INVENTION

An embodiment provides a method of performing backlight adjustment in an RGBW display system. The method includes receiving red, green, and blue sub-pixels of an RGB pixel, generating a color saturation of the RGB pixel according to the red, green, and blue sub-pixels of the RGB pixel, generating a gain corresponding to the RGB pixel according to the color saturation, and adjusting a backlight source according to an average of gains of a plurality of RGB pixels.

Another embodiment provides a backlight adjustment device of an RGBW display system. The backlight adjustment device includes a color saturation generation unit, a gain generation unit, and an adjustment unit. The color saturation generation unit is used for receiving red, green, and blue sub-pixels of an RGB pixel and generating a color saturation of the RGB pixel according to the red, green, and blue sub-pixels of the RGB pixel. The gain generation unit is used for generating a gain corresponding to the RGB pixel according to the color saturation. The adjustment unit is used for adjusting a backlight source according to an average of gains of a plurality of RGB pixels.

The present invention provides a method of performing backlight adjustment in an RGBW display system, and a backlight adjustment device of an RGBW display system. The method of performing backlight adjustment in the RGBW display system, the backlight adjustment device of the RGBW display system utilize a backlight adjustment device to receive red, green, and blue sub-pixels of an RGB pixel, a color saturation generation unit to generate a color saturation according to gray levels of the red, green, and blue sub-pixels, and a gain generation unit to generate a gain of the RGB pixel according to the color saturation. Then, if an RGBW display of the RGBW display system can be adjusted by block, the adjustment unit adjusts luminance of a part of a backlight source corresponding to each block according to an average gain of the plurality of RGB pixels/all RGB pixels of the part of the backlight source corresponding to the block; if the RGBW display can not be adjusted by block, the adjustment unit adjusts luminance of the backlight source according to an average gain of the plurality of RGB pixels/all RGB pixels of the backlight source. Therefore, when the RGBW display displays most of the frames, the RGBW display can reduce power consumption like a traditional RGBW display; when the RGBW display displays frames with higher color saturation, the RGBW display can maintain luminance and colors of the frames. In addition, a processing procedure of the present invention is simpler and faster, so the present invention is suitable for all kinds of RGBW display.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
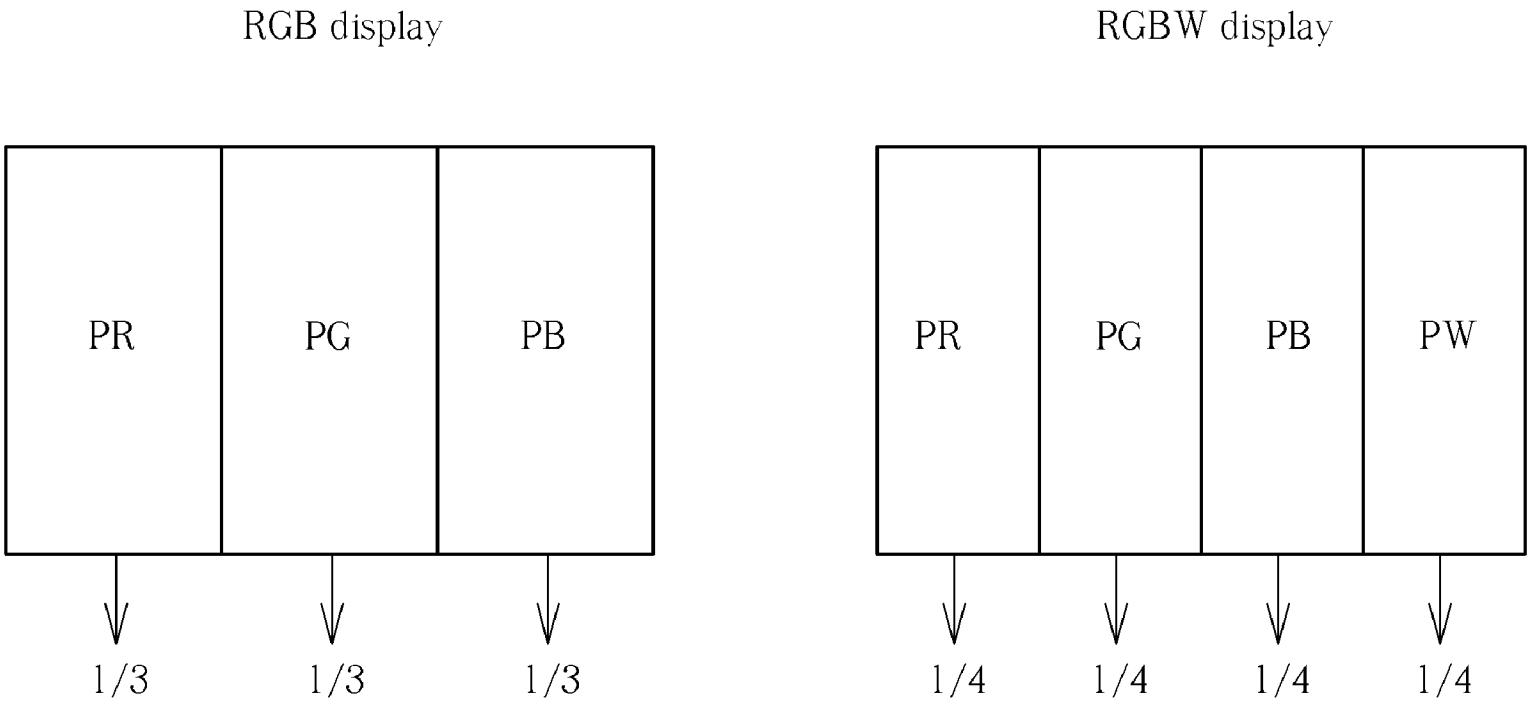
FIG. 1A PRIOR ART
FIG. 1A is a diagram illustrating ratio of a sub-pixel area to a pixel area of the RGB display and ratio of a sub-pixel area to a pixel area of the RGBW display.
Figure 1B:
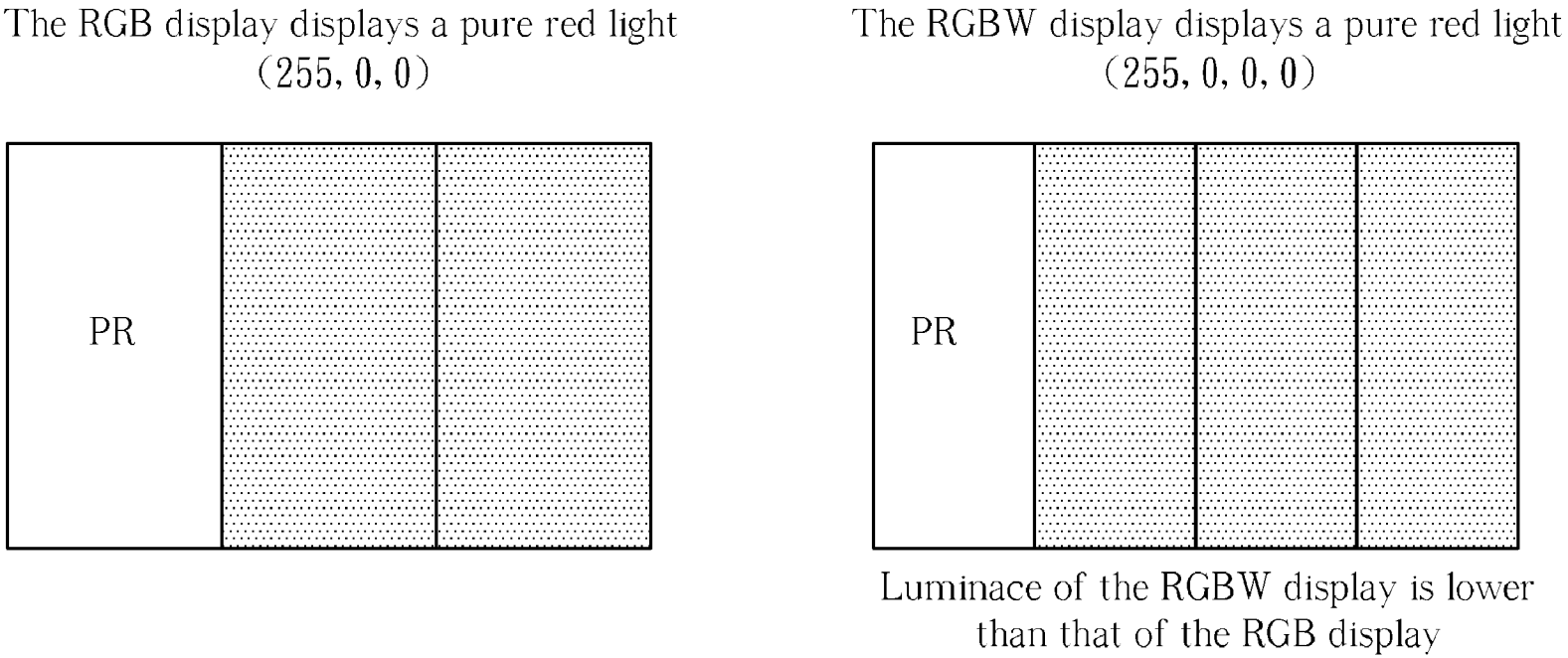
FIG. 1B PRIOR ART
FIG. 1B is a diagram illustrating decrease in the luminance of the images as the RGBW display displays the images with the higher color saturation according to the prior art.
Figure 2:
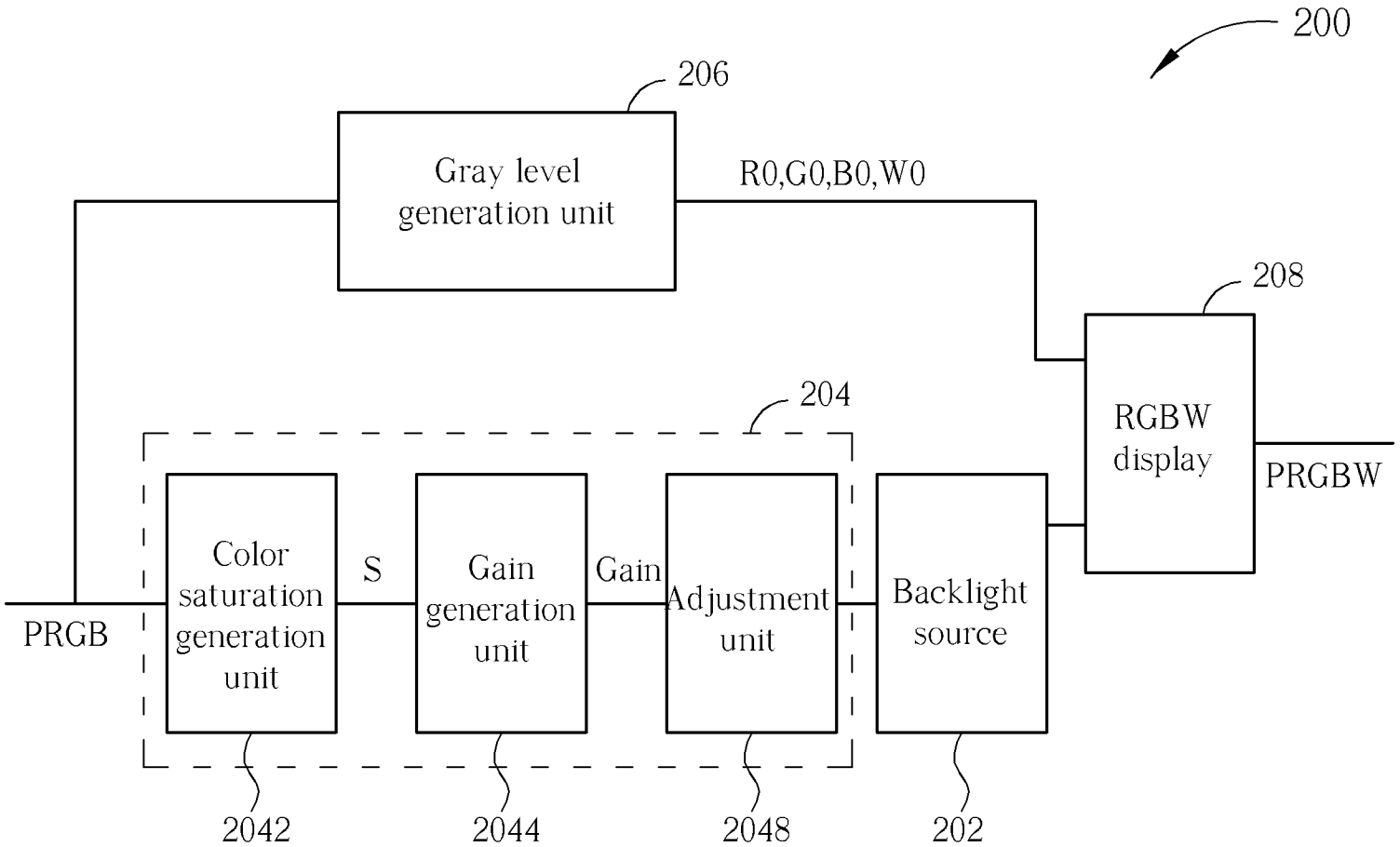
FIG. 2 is a diagram illustrating an RGBW display system according to an embodiment.

Please refer to FIG. 2. FIG. 2 is a diagram illustrating an RGBW display system 200 according to an embodiment. The RGBW display system 200 includes a backlight source 202, a backlight adjustment device 204, a gray level generation unit 206, and an RGBW display 208. The backlight adjustment device 204 is used for receiving red, green, and blue sub-pixels PR, PG, PB of an RGB pixel PRGB, and adjusting the backlight source 202 according to the red, green, and blue sub-pixels PR, PG, PB of the RGB pixel PRGB, where gray levels of the red, green, and blue sub-pixels PR, PG, PB are R, G, and B, respectively. The backlight adjustment device 204 includes a color saturation generation unit 2042, a gain generation unit 2044, and an adjustment unit 2048. The color saturation generation unit 2042 is used for generating a color saturation S of the RGB pixel PRGB according to the gray levels R, G, B of the red, green, and blue sub-pixels PR, PG, PB. The gain generation unit 2044 is coupled to the color saturation generation unit 2042 for generating a gain Gain of the RGB pixel PRGB according to the color saturation S. The adjustment unit 2048 is used for adjusting the backlight source 202 according to an average of gains of a plurality of RGB pixels. The gray level generation unit 206 is used for generating gray levels R0, G0, B0, W0 of red, green, blue, and white sub-pixels PR, PG, PB, PW of an RGBW pixel PRGBW according to the gray levels R, G, B of the red, green, and blue sub-pixels PR, PG, PB. The RGBW display 208 is coupled to the backlight adjustment device 204 and the backlight source 202 is used for displaying the RGBW pixel PRGBW according to the gray levels R0, G0, B0, W0 of the red, green, blue, and white sub-pixels PR, PG, PB, PW and luminance of the backlight source 202.

The color saturation generation unit 2042 substitutes the least gray level Min (R, G, B) and the greatest gray level Max (R, G, B) of the gray levels R, G, B of the red, green, and blue sub-pixels PR, PG, PB into the equation (1) to yield the color saturation S of the RGB pixel PRGB:

$$S = \frac{\max(R, G, B) - \min(R, G, B)}{\max(R, G, B)} \tag{1}$$

The gain generation unit 2044 substitutes the color saturation S into the equation (2) to yield the gain of the RGB pixel PRGB:

$$L = \frac{3}{2} - \frac{3}{4}S \tag{2}$$

$$\text{Gain} = \frac{1}{L} = \frac{4}{6 - 3S}$$

where L is luminance of the RGB pixel PRGB.

Figure 3:
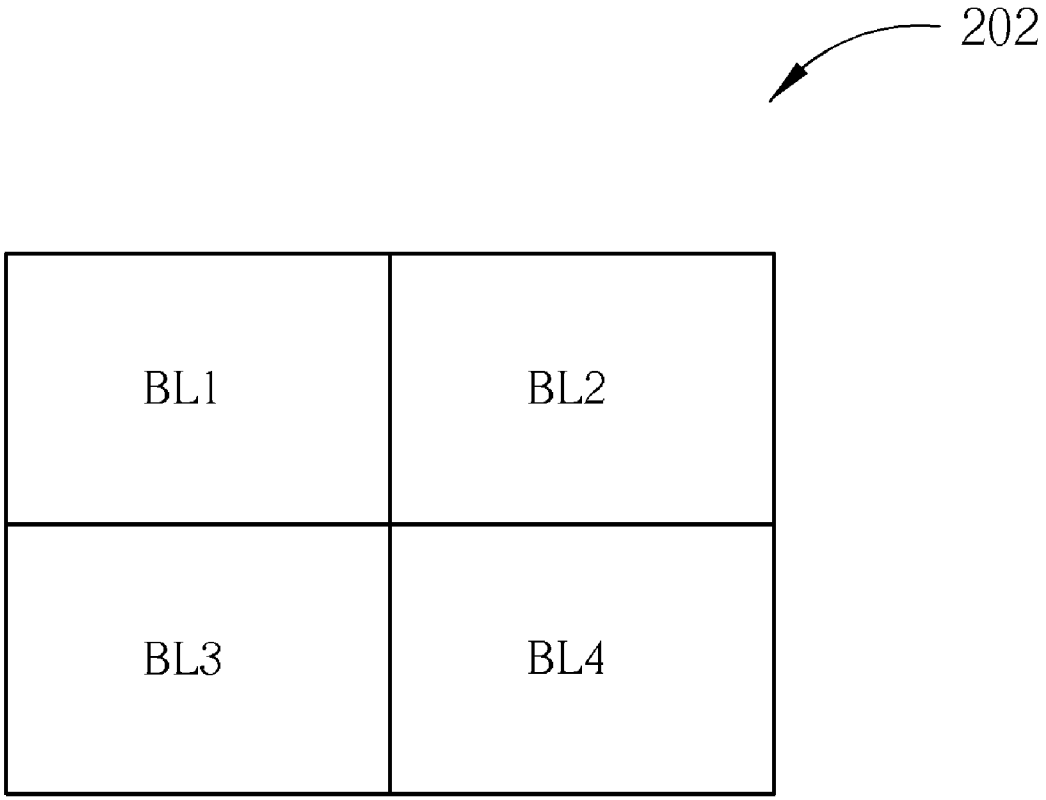
FIG. 3 is a diagram illustrating that the backlight source can be adjusted by block.

Please refer to FIG. 3. FIG. 3 is a diagram illustrating that the backlight source 202 can be adjusted by block. As shown in FIG. 3, the backlight source 202 is divided into four blocks BL1, BL2, BL3, and BL4, but the present invention is not limited to the backlight source 202 being divided into four blocks. The gain generation unit 2044 not only generates a gain of each pixel but also generates average gains AG1, AG2, AG3, and AG4 corresponding to a plurality of RGB pixels of blocks BL1, BL2, BL3, and BL4, respectively. Therefore, the adjustment unit 2048 can adjust luminance of each part of the backlight source 202 corresponding to the blocks BL1, BL2, BL3, and BL4 to AG1, AG2, AG3, and AG4 times original luminance of each part of the backlight source 202 corresponding to the blocks BL1, BL2, BL3, and BL4 according to the average gains AG1, AG2, AG3, and AG4 corresponding to the plurality of RGB pixels of the blocks BL1, BL2, BL3, and BL4. In addition, the adjustment unit 2048 utilizes the average gains AG1, AG2, AG3, and AG4 to adjust the parts of the backlight source 202 corresponding to the blocks BL1, BL2, BL3, and BL4 through pulse-width modulation.

In another embodiment of the present invention, the gain generation unit 2044 not only generates a gain of each pixel but also generates average gains AG1', AG2', AG3', and AG4' corresponding to all RGB pixels of blocks BL1, BL2, BL3, and BL4, respectively. Therefore, the adjustment unit 2048 can adjust luminance of each part of the backlight source 202 corresponding to the blocks BL1, BL2, BL3, and BL4 to AG1, AG2, AG3, and AG4 times original luminance of each part of the backlight source 202 corresponding to the blocks BL1, BL2, BL3, and BL4 according to the average gains AG1', AG2', AG3', and AG4' corresponding to all RGB pixels of the blocks BL1, BL2, BL3, and BL4. Further, subsequent operational principles are the same as those of the RGBW display system 200, so further description thereof is omitted for simplicity.

In another embodiment of the present invention, the backlight source 202 can not be adjusted by block. The gain generation unit 2044 not only generates a gain of each pixel but also generates average gain AG corresponding to a plurality of RGB pixels of the RGBW display 208. Therefore, the adjustment unit 2048 can adjust luminance of the backlight source 202 to AG times original luminance of the backlight source 202 according to the average gain AG corresponding to the plurality of RGB pixels of the backlight source 202. Further, subsequent operational principles are the same as those of the RGBW display system 200, so further description thereof is omitted for simplicity.

In another embodiment of the present invention, the gain generation unit 2044 not only generates a gain of each pixel but also generates average gain AG' corresponding to all RGB pixels of the RGBW display 208. Therefore, the adjustment unit 2048 can adjust luminance of the backlight source 202 to AG' times original luminance of the backlight source 202 according to the average gain AG' corresponding to the all RGB pixels of the backlight source 202. Further, subsequent operational principles are the same as those of the RGBW display system 200, so further description thereof is omitted for simplicity.

Figure 4A:
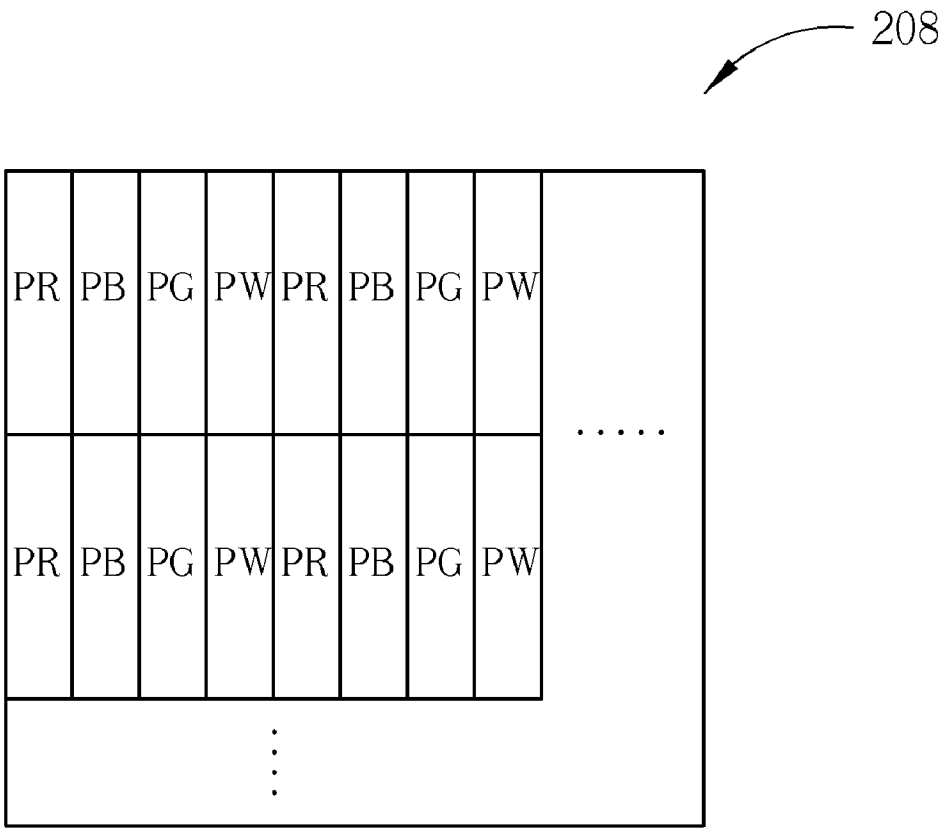
FIG. 4A, FIG. 4B, and FIG. 4C are diagrams illustrating the RGBW display with the different pixel arrays.
Figure 4B:
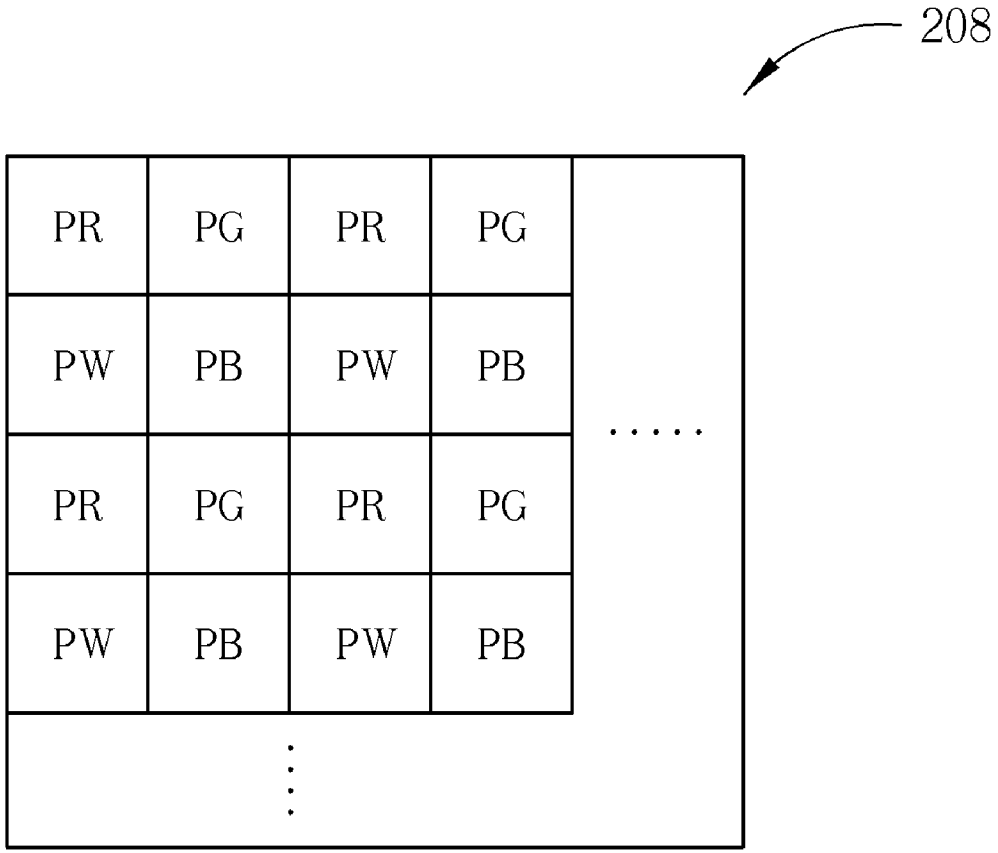
Figure 4C:
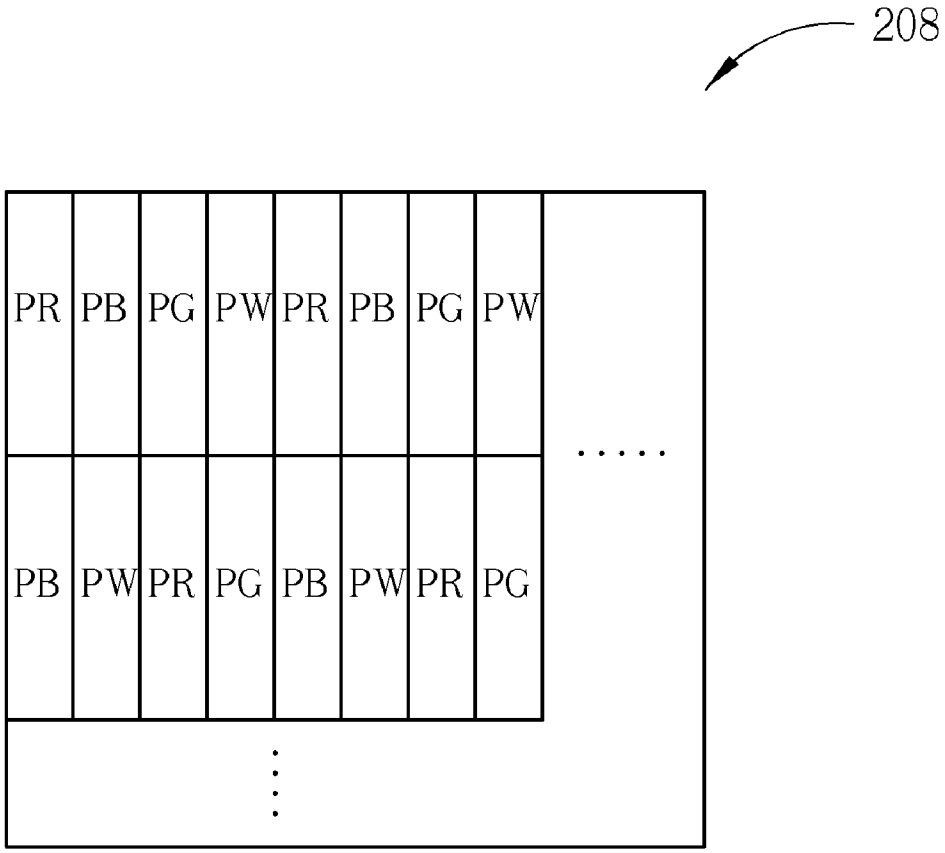

Moreover, the RGBW display system 200 can be applied to the RGBW display 208 with different pixel arrays. Please refer to FIG. 4A, FIG. 4B, and FIG. 4C. FIG. 4A, FIG. 4B, and FIG. 4C are diagrams illustrating the RGBW display 208 with the different pixel arrays. In addition, the RGBW display 208 may be a liquid crystal display, a plasma display, an electrophoresis display, a cathode ray tube display, or any other RGBW display.

Figure 5:
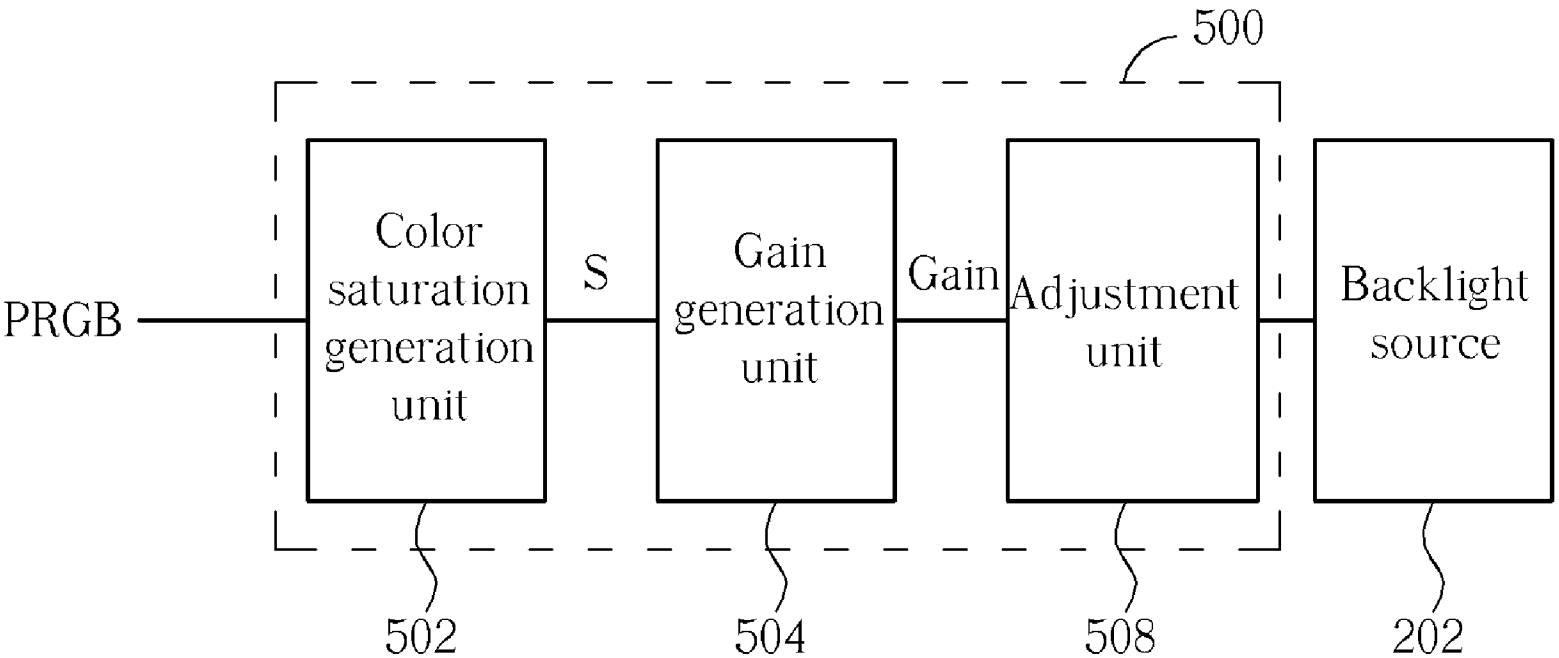
FIG. 5 is a diagram illustrating a backlight adjustment device of an RGBW display system according to another embodiment.

Please refer to FIG. 5. FIG. 5 is a diagram illustrating a backlight adjustment device 500 of an RGBW display system according to another embodiment. The backlight adjustment device 500 includes a color saturation generation unit 502, a gain generation unit 504, and an adjustment unit 508. The color saturation generation unit 502 is used for generating the color saturation S of the RGB pixel PRGB according to the gray levels R, G, B of the red, green, and blue sub-pixels PR, PG, PB of the RGB pixel PRGB. The gain generation unit 504 is coupled to the color saturation generation unit 502 for generating the gain Gain of the RGB pixel PRGB according to the color saturation S. Then, the adjustment unit 508 is used for adjusting the backlight source 202 according to the average of the gains of the plurality of RGB pixels. The color saturation generation unit 502 substitutes the least gray level Min(R, G, B) and the greatest gray level Max(R, G, B) of the gray levels R, G, B of the red, green, and blue sub-pixels PR, PG, PB into equation (1) to yield the color saturation S of the RGB pixel PRGB. The gain generation unit 504 substitutes the color saturation S into equation (2) to yield the gain of the RGB pixel PRGB. Further, subsequent operational principles of the backlight adjustment device 500 are the same as those of the backlight adjustment device 204, so further description thereof is omitted for simplicity.

Figure 6:
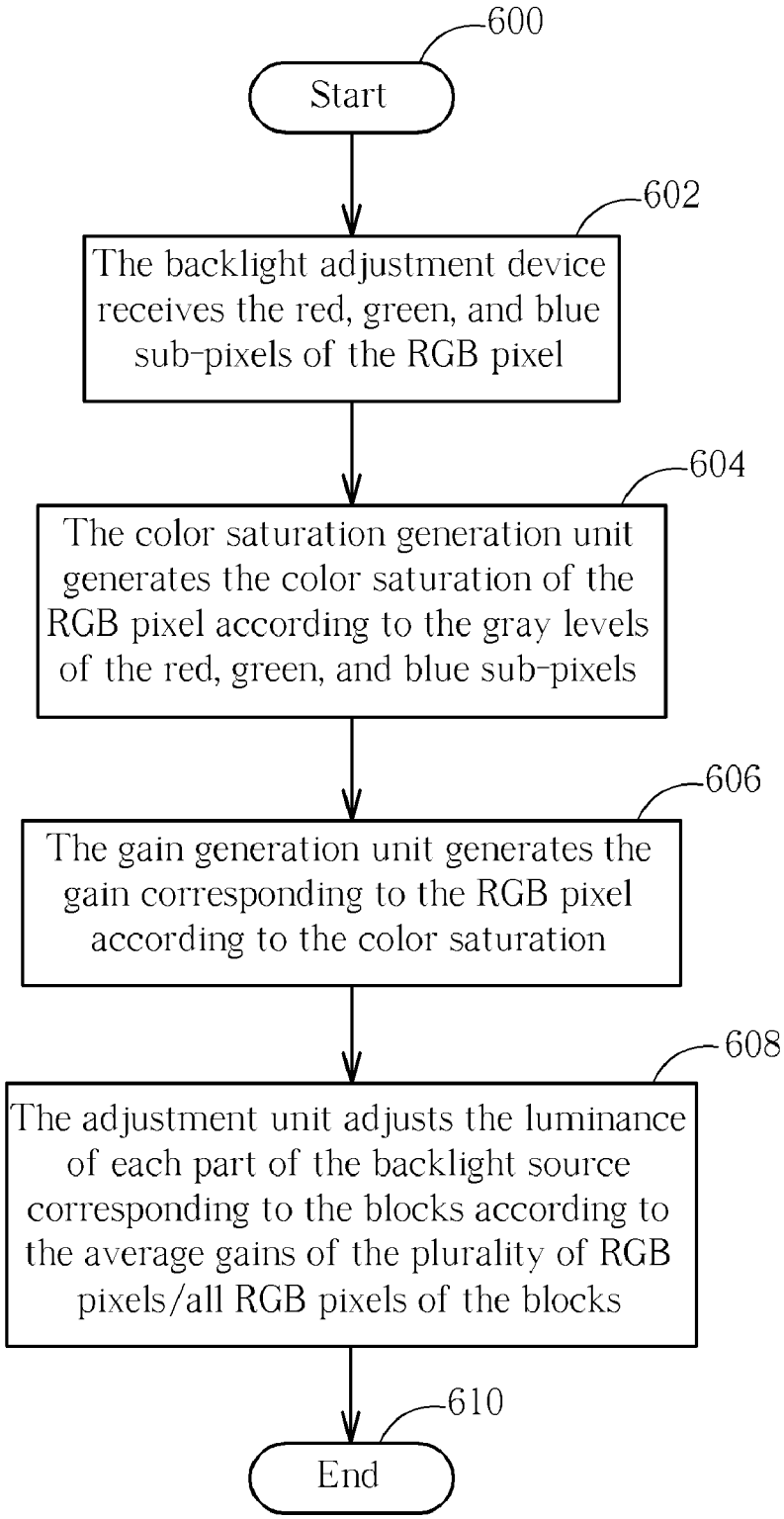
FIG. 6 is a flowchart illustrating a method of performing backlight adjustment in an RGBW display system according to another embodiment.

Please refer to FIG. 6. FIG. 6 is a flowchart illustrating a method of performing backlight adjustment in an RGBW display system according to another embodiment. FIG. 6 uses the RGBW display system 200 of FIG. 2 to illustrate the method. Detailed steps are as follows:

Step 600: Start.

Step 602: The backlight adjustment device 204 receives the red, green, and blue sub-pixels PR, PG, and PB of the RGB pixel PRGB, where the gray levels of the red, green, and blue sub-pixels PR, PG, and PB are R, G, and B.

Step 604: The color saturation generation unit 2042 generates the color saturation S of the RGB pixel according to the gray levels R, G, and B of the red, green, and blue sub-pixels PR, PG, and PB.

Step 606: The gain generation unit 2044 generates the gain corresponding to the RGB pixel PRGB according to the color saturation S.

Step 608: The adjustment unit 2048 adjusts the luminance of each part of the backlight source 202 corresponding to the blocks BL1, BL2, BL3, and BL4 to AG1, AG2, AG3, and AG4/AG1', AG2', AG3', and AG4' times the original luminance of the part of the backlight source 202 corresponding to the blocks BL1, BL2, BL3, and BL4 according to the average gains AG1, AG2, AG3, and AG4/AG1', AG2', AG3', and AG4' of the plurality of RGB pixels/all RGB pixels of the blocks BL1, BL2, BL3, and BL4.

Step 610: End.

In Step 608, the gain generation unit 2044 not only generates the gain of each pixel but also generates the average gains AG1, AG2, AG3, and AG4/AG1', AG2', AG3', and AG4' corresponding to a plurality of RGB pixels/all RGB pixels of the blocks BL1, BL2, BL3, and BL4. Therefore, the adjustment unit 2048 can adjust the luminance of the parts of the backlight source 202 corresponding to the blocks BL1, BL2, BL3, and BL4 to AG1, AG2, AG3, and AG4/AG1', AG2', AG3', and AG4' times the original luminance of the parts of the backlight source 202 corresponding to the blocks BL1, BL2, BL3, and BL4 according to the average gains AG1, AG2, AG3, and AG4/AG1', AG2', AG3', and AG4' corresponding to the plurality of RGB pixels/all RGB pixels of the blocks BL1, BL2, BL3, and BL4.

Figure 7:
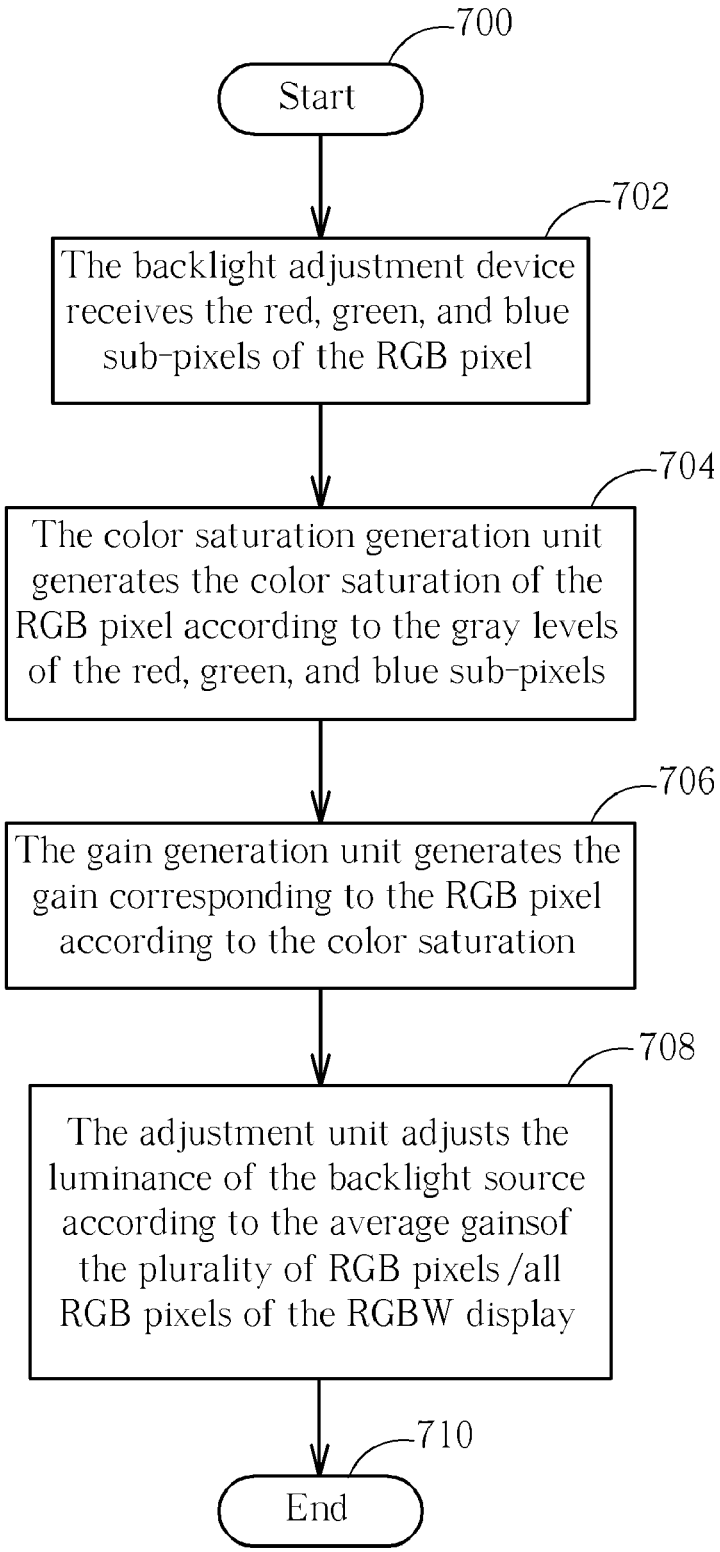
FIG. 7 is a flowchart illustrating a method of performing backlight adjustment in an RGBW display system according to another embodiment.

Please refer to FIG. 7. FIG. 7 is a flowchart illustrating a method of performing backlight adjustment in an RGBW display system according to another embodiment. FIG. 7 uses the RGBW display system 200 of FIG. 2 to illustrate the method. Detailed steps are as follows:

Step 700: Start.

Step 702: The backlight adjustment device 204 receives the red, green, and blue sub-pixels PR, PG, and PB of the RGB pixel PRGB, where the gray levels of the red, green, and blue sub-pixels PR, PG, and PB are R, G, and B.

Step 704: The color saturation generation unit 2042 generates the color saturation S of the RGB pixel according to the gray levels R, G, and B of the red, green, and blue sub-pixels PR, PG, and PB.

Step 706: The gain generation unit 2044 generates the gain corresponding to the RGB pixel PRGB according to the color saturation S.

Step 708: The adjustment unit 2048 adjusts the luminance of the backlight source 202 to AG/AG' times the original luminance of the backlight source 202 according to the average gains AG/AG' of the plurality of RGB pixels/all RGB pixels of the RGBW display 208.

Step 710: End.

In Step 708, the gain generation unit 2044 not only generates the gain of each pixel but also generates the average gains AG/AG' of the plurality of RGB pixels/all RGB pixels of the RGBW display 208. Therefore, the adjustment unit 2048 can adjust the luminance of the backlight source 202 to AG/AG' times the original luminance of the backlight source 202 according to the average gains AG/AG' of the plurality of RGB pixels/all RGB pixels of the RGBW display 208.

To sum up, the method of performing backlight adjustment in the RGBW display system, the backlight adjustment device of the RGBW display system utilize the backlight adjustment device to receive the red, green, and blue sub-pixels of the RGB pixel, the color saturation generation unit to generate the color saturation according to the gray levels of the red, green, and blue sub-pixels, and the gain generation unit to generate the gain of the RGB pixel according to the color saturation. Then, if the RGBW display can be adjusted by block, the adjustment unit adjusts the luminance of the part of the backlight source corresponding to each block according to the average gain of the plurality of RGB pixels/all RGB pixels of the part of the backlight source corresponding to the block; if the RGBW display can not be adjusted by block, the adjustment unit adjusts the luminance of the backlight source according to the average gain of the plurality of RGB pixels/all RGB pixels of the backlight source. Therefore, when the RGBW display of the present invention displays most of the frames, the RGBW display can reduce power consumption like a traditional RGBW display; when the RGBW display of the present invention displays frames with higher color saturation, the RGBW display can maintain luminance and colors of the frames. In addition, a processing procedure of the present invention is simpler and faster, so the present invention is suitable for all kinds of RGBW display.

Those skilled in the art will readily observe that numerous modifications and alterations of the device and method may be made while retaining the teachings of the invention.

What is claimed is:

1. A method of performing backlight adjustment in an RGBW display system, the method comprising:

receiving red, green, and blue sub-pixels of an RGB pixel;

utilizing a first equation $$S = \frac{\max(R, G, B) - \min(R, G, B)}{\max(R, G, B)}$$

to generate a color saturation of the RGB pixel, wherein:

S is the color saturation of the RGB pixel;

R, G, and B are gray levels of the red, green, and blue sub-pixels of the RGB pixel, respectively;

Min(R, G, B) is the lowest gray level of the gray levels of the red, green, and blue sub-pixels; and Max(R, G, B) is the highest gray level of the gray levels of the red, green, and blue sub-pixels;

utilizing a second equation $$L = \frac{3}{2} - \frac{3}{4}S$$

and a third equation $$\text{Gain} = \frac{1}{L} = \frac{4}{6 - 3S}$$

to generate a gain corresponding to the RGB pixel, wherein:

L is luminance of the RGB pixel; and

Gain is the gain of the RGB pixel; and adjusting a backlight source according to an average of gains of a plurality of RGB pixels.

2. The method of claim 1, wherein the backlight source is adjusted by block, and a part of the backlight source corresponding to a block is adjusted according to an average of gains of a plurality of RGB pixels corresponding to the block.

3. The method of claim 2, wherein the average is utilized to adjust the part of the backlight source corresponding to the block through pulse-width modulation.

4. The method of claim 2, wherein the part of the backlight source corresponding to the block is adjusted according to an average of gains of all RGB pixels corresponding to the block.

5. The method of claim 1, wherein the backlight source is not adjusted by block, and the backlight source is adjusted according to an average of gains of a plurality of RGB pixels of an RGBW display of the RGBW display system.

6. The method of claim 5, wherein the average is utilized to adjust the backlight source through pulse-width modulation.

7. The method of claim 5, wherein the backlight source is adjusted according to an average of gains of all RGB pixels of the RGBW display of the RGBW display system.

8. A backlight adjustment device of an RGBW display system, the backlight adjustment device comprising:

a color saturation generation unit for receiving red, green, and blue sub-pixels of an RGB pixel, the color saturation generation unit utilizing a first equation $$S = \frac{\max(R, G, B) - \min(R, G, B)}{\max(R, G, B)}$$

to generate a color saturation of the RGB pixel, wherein:

S is the color saturation of the RGB pixel;

R, G, B are gray levels of the red, green, and blue sub-pixels of the RGB pixel, respectively;

Min(R, G, B) is the lowest gray level of the gray levels of the red, green, and blue sub-pixels; and Max(R, G, B) is the highest gray level of the gray levels of the red, green, and blue sub-pixels;

a gain generation unit for utilizing a second equation $$L = \frac{3}{2} - \frac{3}{4}S$$

and a third equation $$\text{Gain} = \frac{1}{L} = \frac{4}{6 - 3S}$$

to generate a gain corresponding to the RGB pixel, wherein:

L is luminance of the RGB pixel; and

Gain is the gain of the RGB pixel; and an adjustment unit for adjusting a backlight source according to an average of gains of a plurality of RGB pixels.

9. The backlight adjustment device of claim 8, wherein the adjustment unit is used for adjusting a part of the backlight source corresponding to a block according to an average of gains of a plurality of RGB pixels corresponding to the block when the backlight source is adjusted by block.

10. The backlight adjustment device of claim 8, wherein the adjustment unit is used for adjusting a part of the backlight source corresponding to a block according to an average of gains of all RGB pixels corresponding to the block when the backlight source is adjusted by block.

11. The backlight adjustment device of claim 8, wherein the adjustment unit is used for adjusting the backlight source according to an average of gains of a plurality of RGB pixels of an RGBW display of the RGBW display system when the backlight source is not adjusted by block.

12. The backlight adjustment device of claim 8, wherein the adjustment unit is used for adjusting the backlight source according to an average of gains of all RGB pixels of an RGBW display of the RGBW display system when the backlight source is adjusted by block.

* * * * *